US009295109B2

(12) United States Patent
Gerl et al.

(10) Patent No.: US 9,295,109 B2
(45) Date of Patent: Mar. 22, 2016

(54) MIXING DEVICE HAVING INDUCTION HEATING

(75) Inventors: Stefan Gerl, Werbach (DE); Andreas Seiler, Tauberbischofsheim (DE)

(73) Assignee: Maschinenfabrik Gustav Eirich GmbH & Co., KG, Hardheim (DE)

( * ) Notice: Subject to any disclaimer, the term of this patent is extended or adjusted under 35 U.S.C. 154(b) by 1158 days.

(21) Appl. No.: 12/993,979

(22) PCT Filed: Jul. 15, 2009

(86) PCT No.: PCT/EP2009/059098

§ 371 (c)(1),
(2), (4) Date: Nov. 22, 2010

(87) PCT Pub. No.: WO2010/015496

PCT Pub. Date: Feb. 11, 2010

(65) Prior Publication Data

US 2011/0116340 A1 May 19, 2011

(30) Foreign Application Priority Data

Aug. 7, 2008 (DE) ..... 10 2008 041 104

(51) Int. Cl.
*B01F 15/06* (2006.01)
*H05B 6/10* (2006.01)
(Continued)

(52) U.S. Cl.
CPC ..... *H05B 6/105* (2013.01); *B01F 15/065* (2013.01); *B22C 5/044* (2013.01); *F26B 23/04* (2013.01)

(58) Field of Classification Search
CPC ..... B01F 9/10; B01F 9/103; B01F 9/12; B01F 15/065; B01F 15/00396
USPC ..... 366/145, 146, 309, 312
See application file for complete search history.

(56) References Cited

U.S. PATENT DOCUMENTS 2,562,790 A * 7/1951 Houston, Jr. ..... 366/200
2,651,582 A * 9/1953 Courtney ..... 106/167.01
(Continued)

FOREIGN PATENT DOCUMENTS

CN 1715819 A 1/2006
DE 3314824 C2 1/1987
(Continued)

OTHER PUBLICATIONS

Gorbakov et al. Relevance is that during the Examination proceedings in Russia, the Examinier cited said documents against claims 4 to 6, 12 to 16 and 18, Published 1985.

*Primary Examiner* — Charles Cooley
*Assistant Examiner* — Marc C Howell
(74) *Attorney, Agent, or Firm* — Paul & Paul

(57) ABSTRACT

The present invention concerns a mixing device having a preferably rotating container for accommodating material to be mixed, at least one mixing tool arranged in the interior of the container and a heating device for heating the material to be mixed. To provide a mixing device of the kind set forth in the opening part of this specification which permits the fastest possible heating of the material to be mixed, preferably also to temperatures higher than 200° C., it is proposed in accordance with the invention that the container at least partially comprises an electrically conductive material and the heating device has at least one coil which can be excited by an electric alternating field and which is so arranged that eddy currents are produced in the electrically conductive material of the container by the magnetic field change which occurs when the current flow changes.

14 Claims, 4 Drawing Sheets

(51) Int. Cl.
*B22C 5/04* (2006.01)
*F26B 23/04* (2006.01)

(56) References Cited

U.S. PATENT DOCUMENTS

| | | | | | |
|---|---|---|---|---|---|
| 3,073,579 | A | * | 1/1963 | Detrick | 366/200 |
| 4,998,678 | A | | 3/1991 | Durr | |
| 5,016,361 | A | | 5/1991 | Durr | |
| 5,272,720 | A | * | 12/1993 | Cignetti et al. | 373/155 |
| 5,535,236 | A | | 7/1996 | Fischer | |
| 7,172,335 | B1 | * | 2/2007 | O'Connor | 366/142 |
| 7,815,846 | B2 | | 10/2010 | Takahashi | |
| 2001/0010307 | A1 | * | 8/2001 | Saito et al. | 219/390 |
| 2002/0027175 | A1 | * | 3/2002 | Capp | 241/199.12 |
| 2005/0242088 | A1 | * | 11/2005 | Takada et al. | 219/635 |
| 2006/0044935 | A1 | * | 3/2006 | Benelli et al. | 366/145 |
| 2008/0244986 | A1 | | 10/2008 | Adelmann et al. | |

FOREIGN PATENT DOCUMENTS

| | | | |
|---|---|---|---|
| DE | 29602684 | U1 | 7/1996 |
| DE | 19709236 | A1 | 9/1998 |
| DE | 20307420 | | 7/2003 |
| EP | 0326818 | A1 | 8/1989 |
| EP | 0369149 | B1 | 5/1990 |
| EP | 0627606 | A2 | 12/1994 |
| EP | 1508376 | A1 | 2/2005 |
| JP | 5-301037 | B2 | 11/1993 |
| JP | 6-62968 | A | 3/1994 |
| JP | 7-16720 | U | 3/1995 |
| JP | 11-244680 | A | 9/1999 |
| JP | 2002-119427 | A | 4/2002 |
| JP | 2006-061183 | A | 3/2006 |
| RU | 12638 | U1 | 1/2000 |
| WO | 2005105288 | A1 | 11/2005 |

* cited by examiner

MIXING DEVICE HAVING INDUCTION HEATING

BACKGROUND OF THE INVENTION

The invention concerns a mixing device comprising a container for accommodating material to be mixed, a mixing tool arranged in the interior of the container and a heating device for heating the material to be mixed.

Mixing, that is to say combining at least two starting materials having different properties to provide a mixture of substances, is a fundamental operation in mechanical industrial process engineering.

The aim when using a mixing device is to achieve the highest possible level of homogeneity of the new substance. To achieve the desired homogeneity for example mixing devices having a rotating mixing container are used.

In such devices at least one mixing tool is arranged generally eccentrically in the interior of the container. When the container rotates the material to be mixed which is accommodated in the container is transported towards the mixing tool and thoroughly mixed by means thereof. With such mixers, materials of any kind and consistency can be processed quickly and with a high quality.

Experience has shown that a mixer having a rotating container mixes without noticeable separation of the constituents of the mixture as complete rotational turn-over of the material is achieved during a revolution of the mixing container.

As many mixing processes are linked to a chemical reaction which presupposes the supply of a given activation energy, it is already usual for many situations of use for the material to be mixed to be heated during mixing. That is also necessary if thermal liquid removal is to take place in superposed relationship during the mixing operation.

Therefore to permit heating of the material to be mixed in the mixer some mixing devices have a heating casing which surrounds the container wall and is in contact therewith. Heat energy can then be fed into the mixing container by way of the heating casing. Depending on the respective heat transfer medium the heating casing is either in the form of a double casing for hot water or thermal oil heating or, when higher design pressures are involved for vapour heating, the heating casing is in the form of a casing with projections thereon or with half-tubes welded thereto. The known solutions are limited in respect of their maximum wall temperature due to the maximum permissible temperature of the heat transfer medium or in the case of vapour heating due to the necessary compression strength of the double casing.

In addition it is not possible with those solutions to implement fast heating curves up to very high wall temperatures as the heating rate is limited by the heat transfer coefficient from the liquid or the vapour phase to the container wall and the pressure losses and thus the flow speed of the heat transfer medium in the heating casing.

SUMMARY OF THE INVENTION

Therefore having regard to the background of the described state of the art the object of the present invention is to provide a mixing device of the kind set forth in the opening part of this specification, which permits the fastest possible heating of the material to be mixed, preferably even to temperatures of greater than 200° C.

According to the invention that object is attained in that the container at least partially comprises an electrically conductive preferably metallic material and the heating device has at least one coil which can be excited by an electric alternating field and which is so arranged that eddy currents are produced in the electrically conductive material of the container by the magnetic field change which occurs when the current flow changes. Those eddy currents provide an increase in the temperature of the container. That inductive heating of the container permits targeted, direct heating of the container and thus the material to be mixed without a heat transfer medium having to be previously heated. In addition the temperature increase which can be achieved is limited only by the power of the coil and not the chemical-physical properties of the heat transfer medium.

In a preferred embodiment provided in the interior of the container in the proximity of the container wall and/or the container bottom is at least one stripping device which is movable relative to the container wall. In the simplest case the stripping device is static so that the necessary relative movement is produced only by rotation of the container.

The stripping device provides for a continuous vertical component in the flow of material to be mixed and prevents material adhering to or baking on the container wall and/or bottom. In addition with a concentric emptying opening in the bottom of the mixing container, the emptying operation at the end of the mixing time is speeded up.

In a further particularly preferred embodiment the stripping device has a temperature sensor for detecting the temperature of the material to be mixed. The stripping device has proven to be particularly suitable for accommodating a temperature sensor to detect the temperature of the material to be mixed as the stripping device is in direct contact with the material. Alternatively the step of determining the temperature of the material to be mixed can also be effected by way of a temperature sensor which is introduced separately from the stripping device into the mixing chamber and which is contact with the product or which is contact-less.

A further preferred embodiment provides that there are provided at least two separately regulatable heating devices, wherein preferably both heating devices respectively have at least one coil which can be excited by an electric alternating field and which are so arranged that eddy currents are produced in the electrically conductive material of the container by the magnetic field change which occurs when the current flow changes.

To ensure heating of the material to be mixed, that is as uniform as possible, or to adapt the heating power in accordance with the thermal flows into the material to be mixed, it may be advantageous for many situations of use if there are provided a plurality of separately regulatable heating devices, for example one or more of the heating devices can be designed for heating the container bottom and one or more heating devices can be designed for heating the container wall. In addition heating devices can also be provided for heating the mixing tool and/or the stripping device.

In that respect the power of the heating device which is designed to heat the container wall can be the same as or also greater than or less than the power of the heating device for heating the container bottom. In that case the distribution of power between the wall and the bottom preferably approximately corresponds to the surface area ratio between the preferably cylindrical wall surface to be heated directly and the surface of the container bottom that is to be heated directly, preferably a surface in the form of a circular ring or a circular surface. In another particularly preferred embodiment the power distribution to the effectively operative heat transfer surface is based on the material to be mixed in the interior of the container. In a vertically arranged rotating mixing container the bottom surface is usually almost completely covered with material. The heat flow thus takes place over the entire heated bottom surface. In a mixing container which is inclined with respect to the horizontal, having a stationary stripping device, up to about 10-20% of the bottom surface is not directly acted upon with product, depending on the respective arrangement of the stripping device. In the surfaces which are not directly acted upon with product there is thus a markedly lower heat flow which results from the heat loss due to radiation and convection at that location. A comparable aspect applies to the wall surfaces, wherein in addition the material filling directly contacts only a part of the heated wall surface in the stationary condition of not moving relative to the container wall while the part of the heated wall surface, that is disposed thereabove, is in contact with the material to be mixed which is thrown against the wall by the mixing tool, and is thus used for heat transfer.

By way of example, with a surface area ratio between the wall and the bottom of 3:1, a heating power distribution of at least 1:1, preferably at least 1.5:1 and quite particularly preferably at least 2:1, is advantageous.

The container is advantageously of a rotationally symmetrical configuration, wherein a preferred embodiment provides that the heating device for heating the container bottom is so arranged that an outer portion, in the form of a circular ring, of the container bottom is not substantially heated by the heating device, wherein the portion in the form of the circular ring is preferably of a width which is greater than 5% and particularly preferably greater than 10% of the container diameter.

In other words the excitable coil is arranged parallel to the container bottom but not in relation to the described portion in the form of the circular ring. That ensures that no overheating of the container occurs in the region of the container corner, if at the same time the container wall is heated with a second heating device and the field lines of the two coils are concentrated in the corner of the container.

Alternatively or in combination therewith, the heating device for heating the container bottom can be so arranged that an inner circular portion of the container bottom is not substantially heated by the heating device, wherein the circular portion is preferably of a diameter greater than 30%, particularly preferably greater than 50%, of the container diameter.

In other words the excitable coil is arranged in a plane substantially parallel to the container bottom, in which case however an inner circular portion and an outer portion in the form of a circular ring does not have any coil windings in order to ensure that neither the container corner nor the centre of the container bottom are directly heated. In general a suitable drive for the container is disposed in the centre of the container bottom. As the drive or lubricating greases used therein are frequently heat-sensitive, that region is excluded in terms of the dimensioning of the heating device for the container bottom. In another particularly preferred embodiment the drive region is additionally screened in relation to the electromagnetic alternating field of the coil.

In an alternative embodiment, alternatively or in combination a container closure can be inductively heated. In a similar manner the heating device for heating the container wall can be so arranged that a lower portion of the container wall, in the form of a cylindrical surface, is not substantially heated by the heating device, where the lower portion in the form of a cylindrical surface is preferably of a height which is greater than 5% and particularly preferably greater than 10% of the container wall height. That arrangement avoids excessive heating of the container corner due to field superimpositioning with the simultaneous arrangement of a heating device at the container bottom.

In addition the heating device for heating the container wall can be so arranged that an upper portion of the container wall, in the form of a cylindrical surface, is not substantially heated by the heating device, wherein the upper portion in the form of the cylindrical surface is preferably of a height which is greater than 10% and particularly preferably greater than 20% of the container wall height. More specifically, the mixing container is frequently not completely filled with material to be mixed so that the described measure prevents the part of the container wall which is not in contact with the material to be mixed being directly heated.

In a further embodiment the upper portion of the container wall, in the form of a cylindrical surface, can comprise an electrically non-conductive material and/or a material of very low thermal conductivity.

A further particularly preferred embodiment provides that provided between the outside of the container on the one hand and the excitable coil of the at least one heating device on the other hand is an electrically non-conducting, preferably non-metallic insulation element which is preferably secured to the outside of the container. In that case the insulation element is best glued to the outside of the container. That insulation element serves to reduce the delivery of heat from the container to the environment. That saves on energy and reduces the expenditure for affording protection from being touched.

The windings of the coil for the heating device associated with the container bottom can be arranged for example in the proximity of the outside of the container bottom and extend in a spiral around the axis of rotation of the container. That arrangement ensures uniform heating of the container bottom. Alternatively the windings can also be arranged only in a segment of a circle. As the container rotates relative to the windings the entire container bottom is then also heated. Admittedly that arrangement results in less uniform heating of the container bottom, but it can be easily retrofitted to existing mixing devices. In that respect the centre point angle of the segment of the circle is preferably less than 180° and particularly preferably less than 90° and best less than 45°.

Equally the windings of the coil of the heating device associated with the container wall can be arranged in the proximity of the container wall and extend substantially concentrically around the container wall so that substantially the entire container wall, with the exception of the free upper and lower wall portions, can be heated.

In this case also alternatively the windings can also be arranged only in the region of a container wall portion. The rotation of the container ensures that the entire wall can be heated. This arrangement can be more easily retrofitted in existing mixing devices.

Besides the possibility of providing just the wall or just the bottom of the mixing container with a heating element, it would be possible for example to provide a substantially L-shaped heating element, in the two limbs of the L-shape of which is arranged a respective coil. That L-shaped heating element is arranged with one limb parallel to the container wall and the other limb parallel to the container bottom.

For many situations of use it may be advantageous if there is at least one temperature sensor for measuring the container bottom temperature, the temperature sensor preferably being an infrared sensor and detecting the temperature on the outside of the container bottom.

In addition there can be provided at least one temperature sensor for measuring the container wall, in which case also the temperature sensor is preferably an infrared sensor and detectors the temperature on the outside of the container wall. When using infrared sensors the insulation which is possibly provided can have openings so that the temperature of the container bottom and/or the container wall can be detected directly by means of the infrared sensors.

In principle it is possible for the temperature of the container bottom to be very precisely set, with the assistance of the corresponding temperature sensor, by means of the heating device for the container bottom. The temperature of the container wall can also be correspondingly regulated in the same manner. To minimise deformation of the container because of thermal expansion regulation is preferably effected in such a way that the temperature difference between the container bottom on the one hand and the container wall on the other hand is as small as possible.

In a preferred embodiment the excitable coil is at least partially shielded outwardly. That shielding is preferably effected by means of a ferrite shielding.

BRIEF DESCRIPTION OF THE DRAWINGS

Further advantages, features and possible uses of the present invention will be apparent from the description hereinafter of preferred embodiments and the accompanying Figures in which.

DESCRIPTION OF THE INVENTION

Figure 1:
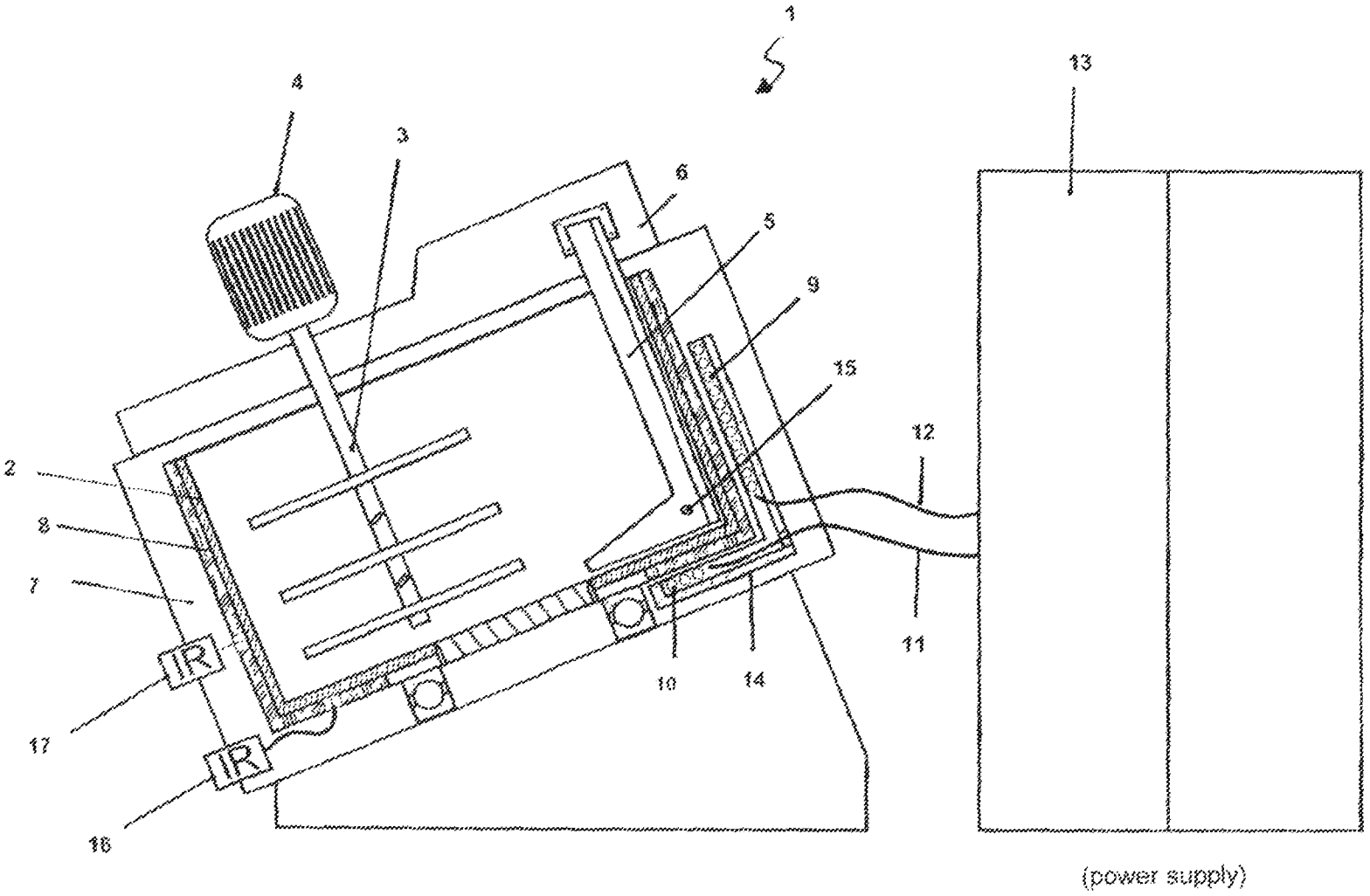
FIG. 1 shows a first embodiment of the invention.

FIG. 1 shows a first embodiment of the mixer 1 according to the invention. The mixer 1 has a container 2 and a mixing tool 3 which is arranged in the container 2 and can be driven by means of a motor 4. The mixing tool 3 is arranged asymmetrically in the container 2.

The container 2 is arranged within a housing 7 having a housing cover 6. It is also possible to see a stripping device 5 fixed to the housing cover 6.

The container 2 is for example of metallic material and is surrounded by an insulating layer 8. Arranged in the housing 7 and substantially parallel to the container bottom and the container wall are two coils 9 and 10 to which an ac voltage can be applied by way of the feed lines 11 and 12 by the power supply 13. In addition suitable cooling media for the dissipation of heat of the lost power in the coil can be transported by way of the same or also separate feed lines. The ac voltage which is transmitted by way of the feed line provides that eddy currents are generated in the container 2, which in turn lead to a rise in the temperature of the container. Both coils 9 and 10 are shielded at least outwardly, preferably also towards the edges, by means of a ferrite shielding 14. That ferrite shielding 14 serves to avoid possible eddy current generation and thus an increase in temperature outside the container.

The heating device 9 associated with the container wall does not extend over the entire container height. An upper region of the container wall which is generally not acted upon with material to be mixed is not heated. In the same manner the heating device 9 also does not extend as far as the corner of the container to avoid excessive heating of the container in the corner.

The heating device 10 for the container bottom is also not taken as far as the corner. In addition a circular central region of the container, by way of which the container is generally driven, is not heated. A first temperature sensor 15 is provided on the stripping device 5 to determine the temperature of the material to be mixed. In addition infrared temperature sensors are arranged in the region of the container wall and in the region of the container bottom. To permit exact temperature measurement the insulation 8 has corresponding openings.

Figure 2:
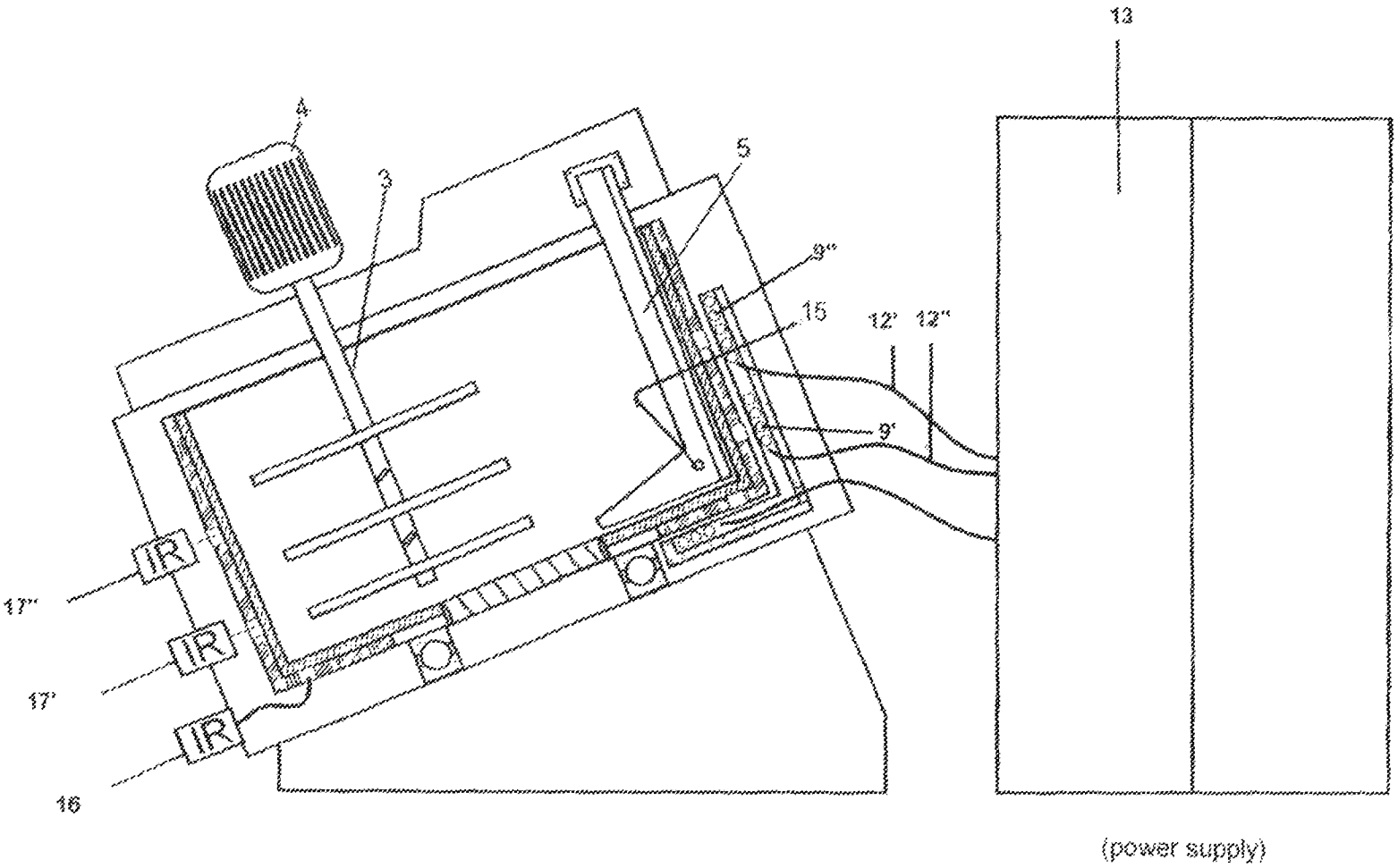
FIG. 2 shows a second embodiment of the invention.

FIG. 2 shows a second embodiment of the mixing device according to the invention.

This embodiment differs from the embodiment shown in FIG. 1 only in that two heating devices 9', 9" are provided to heat the container wall. The two heating devices 9', 9" can both be actuated separately from each other by way of the connections 12', 12" by the power supply 13.

Accordingly, two temperature sensors 17' and 17" are also provided to detect the container wall temperature at two different positions. With this arrangement the heating power levels can be individually adapted over the height of the wall to the thermal power transmitted in the interior of the container.

Figure 3:
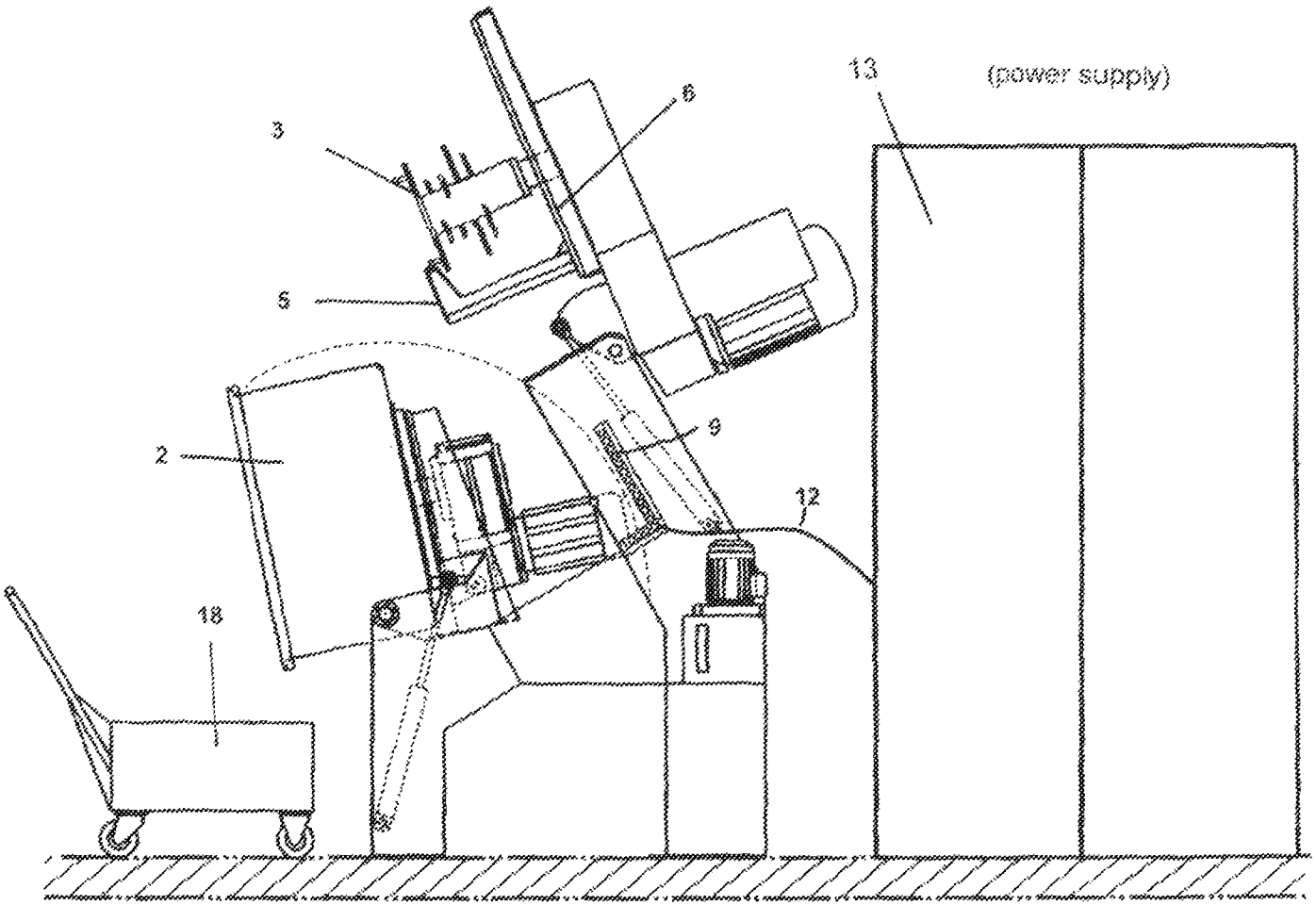
FIG. 3 shows a third embodiment of the invention.

FIG. 3 shows a third embodiment of the mixer according to the invention. It will be seen here that the mixer can be tilted about a horizontal axis. To empty the mixer therefore firstly the housing cover 6 together with the mixing tool 3 and the stripping device 5 is tilted out of the container. The container together with the material to be mixed is then tilted towards the side so that the material to be mixed is transferred into a truck 18 which is provided for those purposes. The heating device which is of a L-shape configuration only comprises in the illustrated case one coil so that the wall and the bottom of the mixing container cannot be individually regulated. A fixed, non-regulatable power distribution between the wall and the bottom can be implemented for example by a different number of windings for the coil in the wall and the bottom. The corner regions between the wall and the bottom can also be substantially excluded from the direct heating effect insofar as the corner region is correspondingly cleared of the windings. That represents a particularly inexpensive embodiment of the invention.

Figure 4:
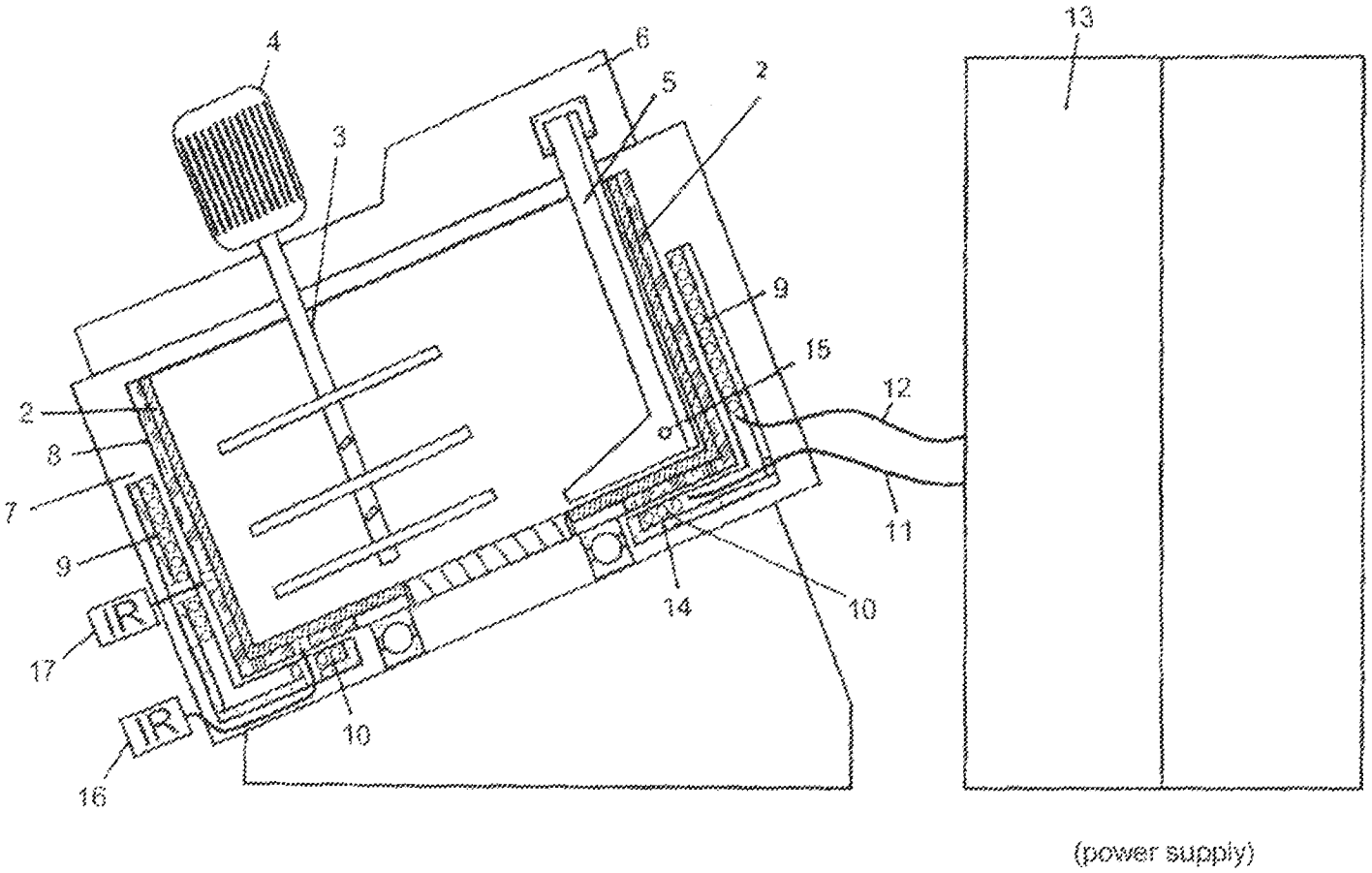
FIG. 4 shows a fourth embodiment of the invention.

FIG. 4 shows a fourth embodiment of the invention. Unlike the embodiment shown in FIGS. 1 and 2 here the coils extend around the entire container and over the entire bottom surface respectively. This embodiment produces uniform heating of the container 2. For most purposes of use however the arrangement of the embodiments 1 and 2 is sufficient, especially as that can be retrofitted to existing mixing devices.

LIST OF REFERENCES

1 mixer
2 container
3 mixing tool
4 motor
5 stripping device
6 housing cover
7 housing
8 insulating layer
9, 9', 9" coil/heating device
10 coil/heating device
11 feed line
12, 12', 12" feed line
13 power supply
14 ferrite shielding
15 temperature sensor
16 infrared sensor
17, 17', 17" infrared sensor
18 truck

The invention claimed is:

1. A mixing device (1) having a housing (7) with a housing cover (6), a rotating container (2) for accommodating material to be mixed, which is arranged within the housing (7), at least one mixing tool (3) arranged in the interior of the container (2), a motor (4) with which the mixing tool (13) can be driven and at least two heating devices (9, 10) for heating the material to be mixed, characterized in that the housing (7) with the rotating container (2) is arranged on a supporting element such that the rotating container (2) is inclined with respect to a horizontal plane parallel to the bottom of the supporting element, provided in the interior of the container (2) in the proximity of the container wall and/or the container bottom on the upper side of the inclination of the container (2) is at least one static stripping device (5) which is movable relative to the container wall, and in that the rotating container (2) at least partially comprises an electrically conductive material and the at least two heating devices (9, 10) are separately regulatable, wherein both heating devices (9, 10) respectively have at least one coil (9, 10) which can be excited by an electric alternating field and which are so arranged that eddy currents are produced in the electrically conductive material of the container (2) by the magnetic field change which occurs when the current flow changes, at least one of the heating devices (10) is arranged substantially parallel to the container bottom and designed to heat the container bottom, wherein the windings of the coil for the heating device associated with the container bottom are arranged only in a segment of a circle and the center point angle of the segment of the circle is less than 180°, and at least one further heating device (9) is arranged substantially parallel to the container wall and designed to heat the container wall, wherein the windings of the coil for the heating device associated with the container wall are arranged substantially in the shape of a cylinder portion covering less than 180° of the container wall, such that the two heating devices (9, 10) substantially form an L-shape with one limb parallel to the container wall and the other limb parallel to the container bottom.

2. A mixing device (1) according to claim 1 characterised in that provided in the interior of the container (2) is a temperature sensor (15) for determining the temperature of the material to be mixed, wherein the temperature sensor (15) is arranged at or in the stripping device (5).

3. A mixing device (1) according to claim 1 characterised in that the ratio of the power of the heating device (9) designed to heat the container wall to the power of the heating device (10) designed to heat the container bottom approximately corresponds to the surface area ratio of the heated wall surface and the heated bottom surface.

4. A mixing device (1) according to claim 1 characterised in that the container (2) is rotationally symmetrical and the heating device (10) for heating the container bottom is so arranged that an outer portion of the container bottom, in the form of a circular ring, is not substantially heated by the heating device (10), wherein the portion in the form of a circular ring is of a width greater than 5% of the container diameter.

5. A mixing device (1) according to claim 1 characterised in that the container (2) is rotationally symmetrical and the heating device (10) for heating the container bottom is so arranged that an inner circular portion of the container bottom is not substantially heated by the heating device (10), wherein the circular portion is of a diameter greater than 50% of the container diameter.

6. A mixing device (1) according to claim 1 characterised in that the container (2) is rotationally symmetrical and the heating device (9) for heating the container wall is so arranged that a lower portion of the container wall, in the form of a cylindrical surface, is not substantially heated by the heating device (9), wherein the lower portion in the form of a cylindrical surface is of a height greater than 10%, of the container wall height.

7. A mixing device according to one of claim 1 characterised in that the container (2) is rotationally symmetrical and the heating device (9) for heating the container wall is so arranged that an upper portion of the container wall, in the form of a cylindrical surface, is not substantially heated by the heating device (9), wherein the upper portion in the form of a cylindrical surface is of a height greater than 20%, of the container wall height.

8. A mixing device (1) according to claim 1 characterised in that the upper portion of the container wall, in the form of a cylindrical surface, is made of an electrically non-conductive material and/or a material of very low thermal conductivity.

9. A mixing device (1) according to claim 1 characterised in that provided between the outside of the container and the excitable coil of the at least one heating device (9, 10) is a non-metallic insulating element which is preferably secured to the outside of the container by way of a non-releasable connection.

10. A mixing device (1) according to claim 1 characterised in that an excitable coil is arranged in the proximity of the outside of the container bottom and has a plurality of windings which extend substantially in a spiral around the axis of rotation of the container (2).

11. A mixing device (1) according to claim 1 characterised in that an excitable coil is arranged in the proximity of the outside of the container bottom and has a plurality of windings which extend substantially around the container wall.

12. A mixing device (1) according to claim 1 characterised in that there is provided a temperature sensor (16) for measuring the container bottom temperature, wherein the temperature sensor (16) is an infrared sensor.

13. A mixing device (1) according to one of claim 1 characterised in that there is provided a temperature sensor (17) for measuring the container wall, wherein the temperature sensor (17) is an infrared sensor.

14. A mixing device (1) according to one of claim 1 characterised in that the excitable coil is at least partially shielded outwardly by means of a ferrite shielding (14).

* * * * *